US005740911A

United States Patent [19]

Chou

[11] Patent Number: 5,740,911

[45] Date of Patent: Apr. 21, 1998

[54] DISPLAY PACK HAVING A SECURITY DEVICE

[76] Inventor: Ta-Ching Chou, No. 22, West 4th Alley, 20 Lin, Hsi Ping Li, Hua Hsia Lane, Hsi Tun Dist., Taichung, Taichung, Taiwan

[21] Appl. No.: 838,781

[22] Filed: Apr. 10, 1997

[51] Int. Cl.[6] ..... B65D 73/00

[52] U.S. Cl. ..... 206/378; 206/1.5; 206/806; 248/214; 248/317

[58] Field of Search ..... 206/349, 376, 206/378, 775, 1.5, 806; 248/214, 317, 686, 215, 216.1

[56] References Cited

U.S. PATENT DOCUMENTS 5,425,519 6/1995 Budert ..... 206/378 X 5,484,056 1/1996 Wood ..... 206/349

*Primary Examiner*—Jacob K. Ackun

*Attorney, Agent, or Firm*—Staas & Halsey

[57] ABSTRACT

A display pack having a security device includes a hanging portion with a disk extending laterally therefrom which has at least two opposite walls extending therefrom, and a securing member. The hanging portion has a first hole defined therethrough and the disk has a second hole defined therethrough, each of the side walls has a protrusion extending therefrom so that the two side walls are securely inserted into a socket with the protrusion engaging with a recess defined in an inner periphery of the socket. The securing member has a flange extending radially from a lower end thereof and a hook member extending from an upper end thereof so that the securing member extends through the socket and the hook member is engaged with the second hole of the disk.

3 Claims, 5 Drawing Sheets

DISPLAY PACK HAVING A SECURITY DEVICE

BACKGROUND OF THE INVENTION

1. Field of the Invention

The present invention relates to a display pack and, more particularly, to a display pack having a security device disposed thereto so as to prevent a tool from being taken unauthorisedly from the display pack.

2. Brief Description of the Prior Art

A conventional display pack for a tool being attached thereto is shown in FIG. 5, wherein the display pack 50 is used to let a socket 60 be attached thereto and the display pack 50 is designed to be hung on display arms of a hardware store so that customers can see the socket clearly. The display 50 includes a plate 51 through which a hole 510 is defined, and a block 52 which extends from a lower edge of the plate 51. The block 52 has a protrusion 53 extending from at least one of four sides thereof so that the block 52 may insert into an engaging hole 61 of the socket 60 and the protrusion 53 is received in a recess 62 defined in at least one of four sides defining the engaging hole 61, such that the socket 60 is attached to the display pack 50.

However, the socket 60 can easily be taken unauthorisedly from the display pack 50 and such theft is a serious problem for the manager of the hardware store. Furthermore, in order to manufacture a block 52 which is sized to be suitably inserted into the engaging hole 61 of the socket 60, the block 52 is required to be formed precisely and this results in a high manufacturing cost.

The present invention intends to provide an improved display pack which is designed to mitigate and/or obviate the above-mentioned problems.

SUMMARY OF THE INVENTION

The present invention provides a display pack having a security device and includes a hanging portion with a disk extending laterally from a lower edge thereof, wherein the hanging portion has a first hole defined therethrough and the disk has a second hole defined therethrough. At least two opposite side walls extend from the disk and in a direction opposite the hanging portion. Each of the side walls has at least one protrusion extending therefrom. A securing member has an upper end and a lower end from which a flange extends radially. The upper end of the securing member has a hook member extending therefrom so that the securing member extends through a socket attached to the side walls and the hook member is engaged with the second hole to position the socket relative to the side walls.

It is an object of the present invention to provide a display pack which has a security device to securely connect a socket to the display pack and socket cannot be taken from the display pack unless the hook member is broken.

It is another object of the present invention to provide a display pack which can be used repeatedly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
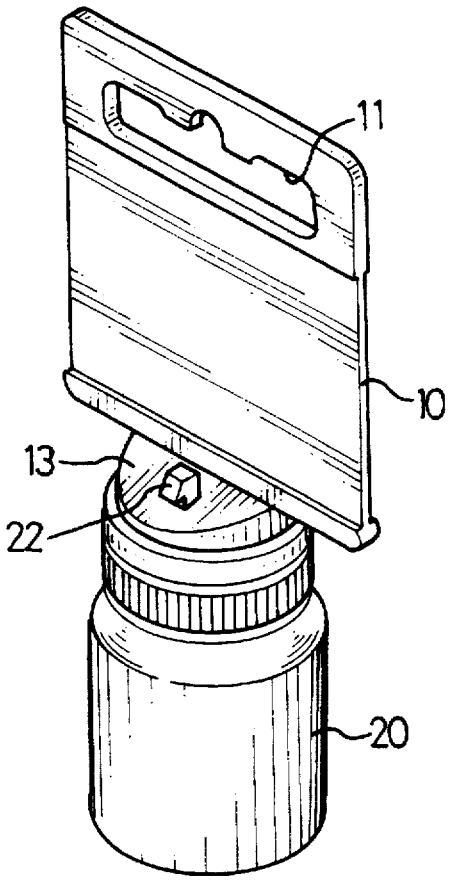
FIG. 1 is a perspective view of a display pack in accordance with the present invention and a socket connected to the display pack.
Figure 2:
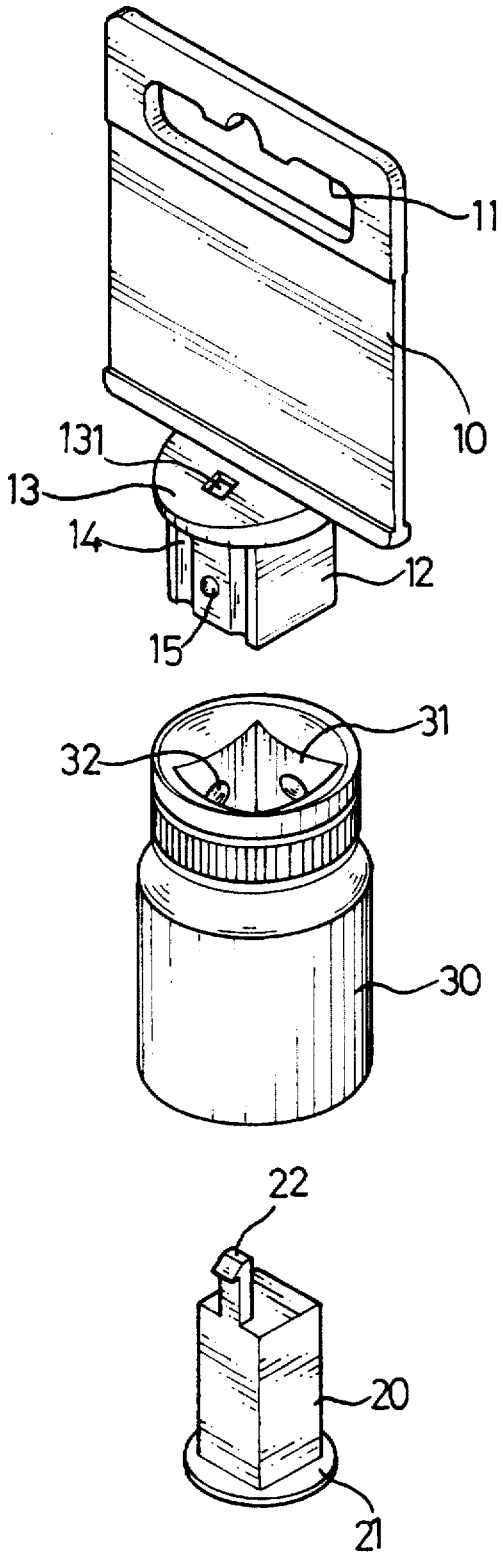
FIG. 2 is an exploded view of the display pack in accordance with the present invention and the socket.
Figure 3:
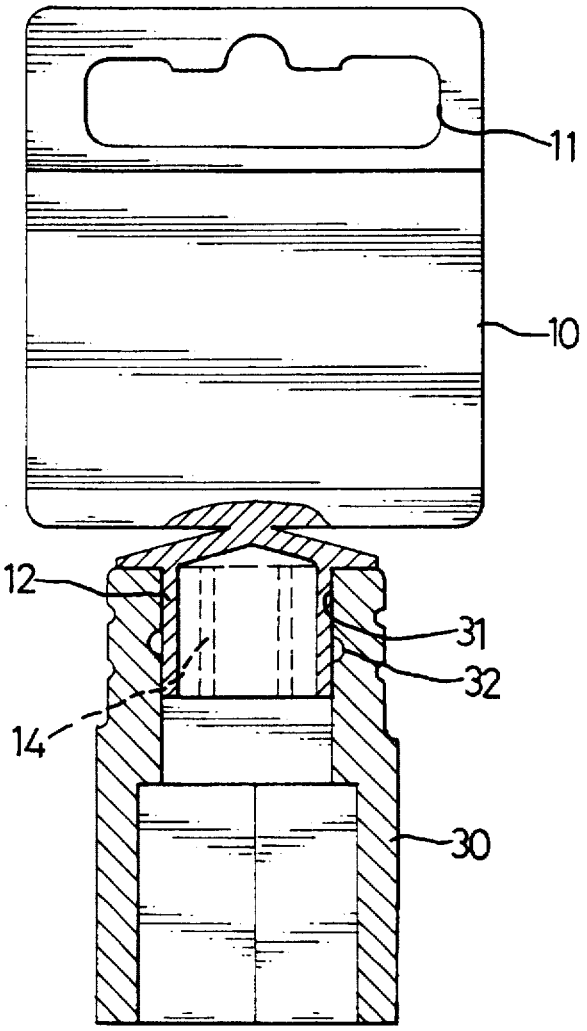
FIG. 3 is a side elevational view, partly in section, of the engagement of the socket and the display pack.

Referring to the drawings and initially to FIGS. 1 through 3, a display pack having a security device in accordance with the present invention generally includes a hanging portion. In this embodiment the hanging portion is a plate 10 having a first hole 11 defined therethrough and a disk 13 extending laterally from a lower edge of the plate 10 with a center of the disk 13 located on the lower edge of the plate 10. The disk 13 has a second hole 131 defined therethrough and at least two opposite side walls, four side walls 12 in this embodiment, extend from the disk 13 and toward opposite from the plate 10. Two opposite side walls 12 as mentioned above have at least one protrusion 15 extending therefrom and two longitudinal grooves 14 defined therein so that the two opposite side walls 12 are flexible so as to facilitate the side walls 12 to inserted into an engaging hole 31 of a socket 30. The engaging hole 31 has at least one recess 32 defined in an inner periphery defining the engaging hole 31 so that the protrusion 15 is received in the corresponding recess 32 so as to attach the socket 30 to the side walls 12.

A securing member 20 has an upper end and a lower end from which a flange 21 extends radially, and the upper end of the securing member has a hook member 22 extending therefrom.

Figure 4:
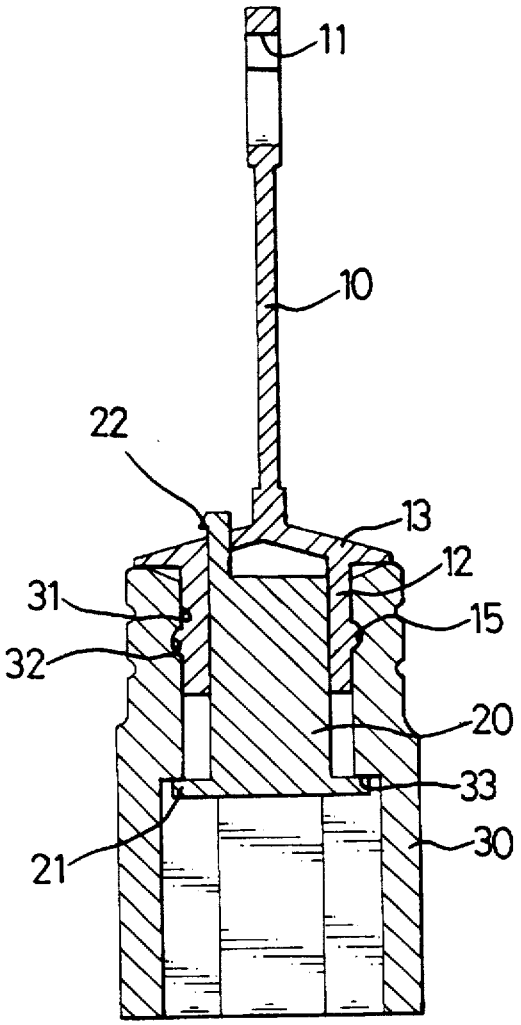
FIG. 4 is a side elevational view, partly in section, of the engagement of the socket and the display pack including the securing member.
Figure 5:
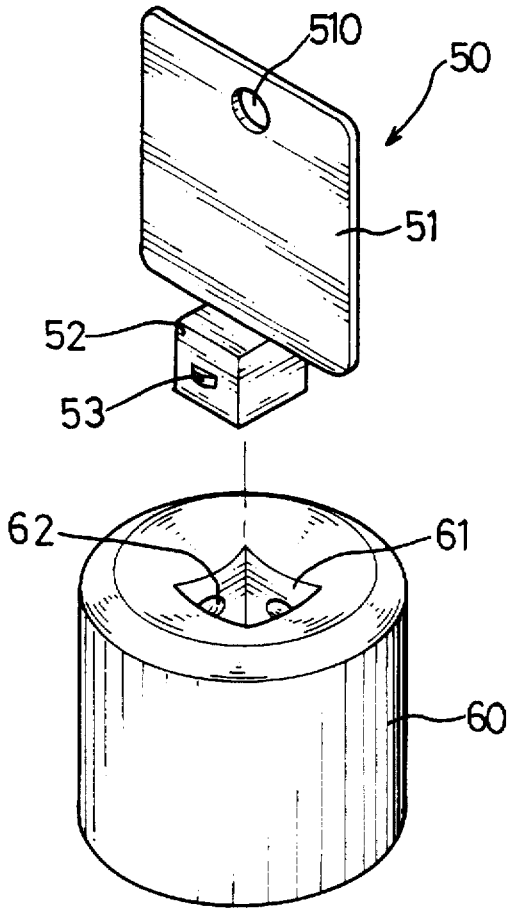
FIG. 5 PRIOR ART
FIG. 5 is an exploded view of a conventional display pack and a socket.

Referring to FIG. 4, when using the display pack in accordance with the present invention, the securing member 20 extends through the socket 30 and the hook member 22 is received in the second hole 131 in the disk 13 wherein the flange 21 is engaged against a Shoulder portion 33 in the socket 30. The shoulder portion 33 is defined between the inner periphery defining the engaging hole 31 and an inner periphery defining an open lower end of the socket 30. The socket 30 therefore cannot be taken from the display pack simply by pulling the socket 30 downwardly unless the hook member 22 is cut by a tool such as a pair of scissors. Furthermore, a display arm (not shown) extends throuth the first hole of the display pack and from which the display pack is suspended. The display arm is suitably equipped such that only an authorized person can disengage the display pack from the display arm.

The present invention efficiently prevents the socket 30 attached to the display pack from being easily separated from the display pack without permission and the display pack can be used repeatedly with a new securing member 20 applied.

Although the invention has been explained in relation to its preferred embodiment, it is to be understood that many other possible modifications and variations can be made with out departing from the spirit and scope of the invention as hereinafter claimed.

What is claimed is:

1. A display pack having a security device, comprising:

a hanging portion having a first hole defined therethrough and a disk extending laterally from a lower edge of said hanging portion, said disk having a second hole defined therethrough, at least two opposite side walls extending from said disk and in a direction opposite said hanging portion, each of said side walls having at least one protrusion extending therefrom, and a securing member having an upper end and a lower end from which a flange extends radially, said upper end of said securing member having a hook member extending therefrom so that said securing member extends through a product attached to said side walls and said hook member is engaged with said second hole to position said product relative to said side walls.

2. The display pack as claimed in claim 1 wherein the number of said side walls is four and each of said two opposite side walls has a two longitudinal grooves defined therein.

3. The display pack as claimed in claim 1 wherein said hanging portion is a plate.

* * * * *